US010942480B2

(12) United States Patent
Motoyama

(10) Patent No.: US 10,942,480 B2
(45) Date of Patent: Mar. 9, 2021

(54) IMAGE FORMING APPARATUS WITH DETECTION OF ABNORMALITY OF POWER SOURCE DEVICE OR AN OPTICAL SCANNING DEVICE

(71) Applicant: CANON KABUSHIKI KAISHA, Tokyo (JP)

(72) Inventor: Hajime Motoyama, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 156 days.

(21) Appl. No.: 16/123,983

(22) Filed: Sep. 6, 2018

(65) Prior Publication Data

US 2019/0079437 A1 Mar. 14, 2019

(30) Foreign Application Priority Data

Sep. 11, 2017 (JP) ..... JP2017-174395

(51) Int. Cl.

| | |
|---|---|
| ***G03G 15/00*** | (2006.01) |
| ***G03G 15/20*** | (2006.01) |
| ***G03G 15/043*** | (2006.01) |
| ***G03G 15/04*** | (2006.01) |

(52) U.S. Cl.

CPC ..... *G03G 15/5004* (2013.01); *G03G 15/043* (2013.01); *G03G 15/04072* (2013.01); *G03G 15/2003* (2013.01); *G03G 15/55* (2013.01); *G03G 15/80* (2013.01)

(58) Field of Classification Search

CPC ..... G03G 15/5004; G03G 15/04072; G03G 15/043; G03G 15/2003; G03G 15/55; G03G 15/80

See application file for complete search history.

(56) References Cited

U.S. PATENT DOCUMENTS

| | | | | |
|---|---|---|---|---|
| 2006/0033804 | A1* | 2/2006 | Dan | G02B 26/121 347/230 |
| 2009/0021570 | A1* | 1/2009 | Motoyama | G03G 15/04072 347/129 |
| 2009/0109205 | A1* | 4/2009 | Mutoh | H04N 5/2624 345/212 |
| 2015/0236627 | A1* | 8/2015 | Hirata | H02P 6/20 347/261 |

(Continued)

FOREIGN PATENT DOCUMENTS

JP 9-123519 A 5/1997

*Primary Examiner* — David H Banh

(74) *Attorney, Agent, or Firm* — Canon U.S.A., Inc. IP Division

(57) ABSTRACT

In an image forming apparatus, if a controller detects an abnormality in an output voltage of the power source device, the controller notifies the abnormality of the power source device. If the controller detects no abnormality in the output voltage after image data is input and before a scanner motor is activated in response to the input of the image data, the controller activates the scanner motor. If a rotary polygon mirror does not reach a target speed within a predetermined time, the controller re-detects whether there is an abnormality in the output voltage. If the controller detects an abnormality in the output voltage, the controller notifies the abnormality of the power source device. If the controller detects no abnormality in the output, the controller notifies the abnormality of the optical scanning device.

19 Claims, 7 Drawing Sheets

(56) References Cited

U.S. PATENT DOCUMENTS

2015/0331352 A1* 11/2015 Motoyama ..... G03G 15/043
347/118
2019/0101843 A1* 4/2019 Kamei ..... G03G 15/80

* cited by examiner

IMAGE FORMING APPARATUS WITH DETECTION OF ABNORMALITY OF POWER SOURCE DEVICE OR AN OPTICAL SCANNING DEVICE

BACKGROUND OF THE INVENTION

Field of the Invention

One disclosed aspect of the embodiments relates to a notification of error information about an electrophotographic image forming apparatus.

Description of the Related Art

In an optical scanning device for use in an electrophotographic image forming apparatus, a rotary polygon mirror driven by a scanner motor is used to deflect laser light to scan a photosensitive member. The following describes activation control of the scanner motor at the time of starting printing. First, when a start signal which is an instruction to start printing is input, the scanner motor in a stopped state starts rotating at full speed. In general, a motor used as the scanner motor includes a Hall element to detect the location of a rotor, and the rotation speed of the scanner motor is detectable by measuring the period of a frequency generator (FG) signal output by the Hall element. When the rotation speed of the scanner motor that is detected based on the FG signal reaches a predetermined speed, emission of laser light is started. After the laser is lit, a beam detector having detected the laser light outputs a beam detection (BD) signal which is a writing detection signal of a scan over the photosensitive member. The rotation speed control is realized with greater accuracy by controlling the speed of the scanner motor based on the rotation speed detected by measuring the period of the BD signal. Next, the phases of the BD signal and a reference signal are controlled to align the writing positions of each color (each photosensitive member). Then, if it is detected that the phases of the reference signal and the BD signal match, a phase lock signal is output, and image forming is started.

Further, a control unit of the image forming apparatus measures time between the start of the rotation of the scanner motor of the optical scanning device and the output of the phase lock signal, and if no phase lock signal is output within a predetermined time, the control unit determines that the scanner motor is in an abnormal state. Then, the control unit displays an error and stops the image forming operation. However, there can be cases in which the control unit erroneously determines that the scanner motor is in the abnormal state when in reality, the laser diode is in the abnormal state. Thus, for example, Japanese Patent Application Laid-Open No. 9-123519 discusses a method in which a unit for determining a rotation state of a scanner motor and a unit for detecting an output state of a laser light detection device are provided and it is determined whether an abnormality has occurred in the scanner motor based on the rotation state of the scanner motor and the output state of laser light.

However, in the conventional method described above, it can be determined that the abnormality has occurred in the scanner motor even when no phase lock signal is generated within a predetermined time because the scanner motor is unsuccessfully activated due to decrease in voltage supplied from a power source device during the activation of the scanner motor. As described above, the scanner motor is activated through several control modes, and in a case where the processing has not proceeded to the phase lock, a notification of an abnormality in the scanner motor is issued in the form of an error display regardless of the control mode in which the abnormality is occurring. When the notification of the abnormality in the scanner motor is displayed although the abnormality has occurred in reality not in the scanner motor but in the power source device, since the error display indicates that the abnormality has occurred in the scanner motor, an operator or serviceman recognizes that the abnormality has occurred in the scanner motor. Consequently, a problem arises that it takes a significant amount of time and effort for the operator or serviceman to determine the cause of the abnormality in the optical scanning device and remove the cause

SUMMARY OF THE INVENTION

One aspect of the embodiments is directed to a technique for accurately notifying that an optical scanning device is not activated due to an abnormality in a power source device of an image forming apparatus.

According to an aspect of the embodiments, an image forming apparatus includes an image forming portion, a power source device, a voltage detection unit, a rotation detection unit, and a controller. The image forming portion includes a photosensitive member, a light source configured to emit laser light, a rotary polygon mirror configured to deflect the laser light to scan the photosensitive member with the laser light, and an optical scanning device including a driving motor configured to rotate the rotary polygon mirror. The image forming portion is configured to perform image forming by developing an electrostatic latent image formed on the photosensitive member with a toner. The power source device is configured to supply power to the image forming portion. The voltage detection unit is configured to detect an output voltage of the power source device. The rotation detection unit is configured to output a detection signal matching to a rotation speed of the rotary polygon mirror The controller is configured to activate the driving motor with the power supplied from the power source device to cause the image forming portion to form an image in response to input of image data for forming the image. The controller detects whether an abnormality occurs in the power source device or the optical scanning device based on a detection result of the voltage detection unit and a detection result of the rotation detection unit. The controller notifies where the abnormality occurs. If the controller detects an abnormality in the output voltage of the power source device, the controller notifies the abnormality of the power source device. If the controller detects no abnormality in the output voltage of the power source device after the image data is input and before the driving motor is activated in response to the input of the image data, the controller activates the driving motor. If the rotary polygon mirror does not reach a target speed within a predetermined time, the controller re-detects whether there is the abnormality in the output voltage of the power source device. If the controller detects the abnormality in the output voltage of the power source device in re-detecting whether there is the abnormality in the output voltage of the power source device, the controller notifies the abnormality of the power source device. If the controller detects no abnormality in the output voltage of the power source device in re-detecting whether there is the abnormality in the output voltage of the power source device, the controller notifies the abnormality of the optical scanning device.

Further features of the disclosure will become apparent from the following description of exemplary embodiments with reference to the attached drawings.

DESCRIPTION OF THE EMBODIMENTS

Figure 1:
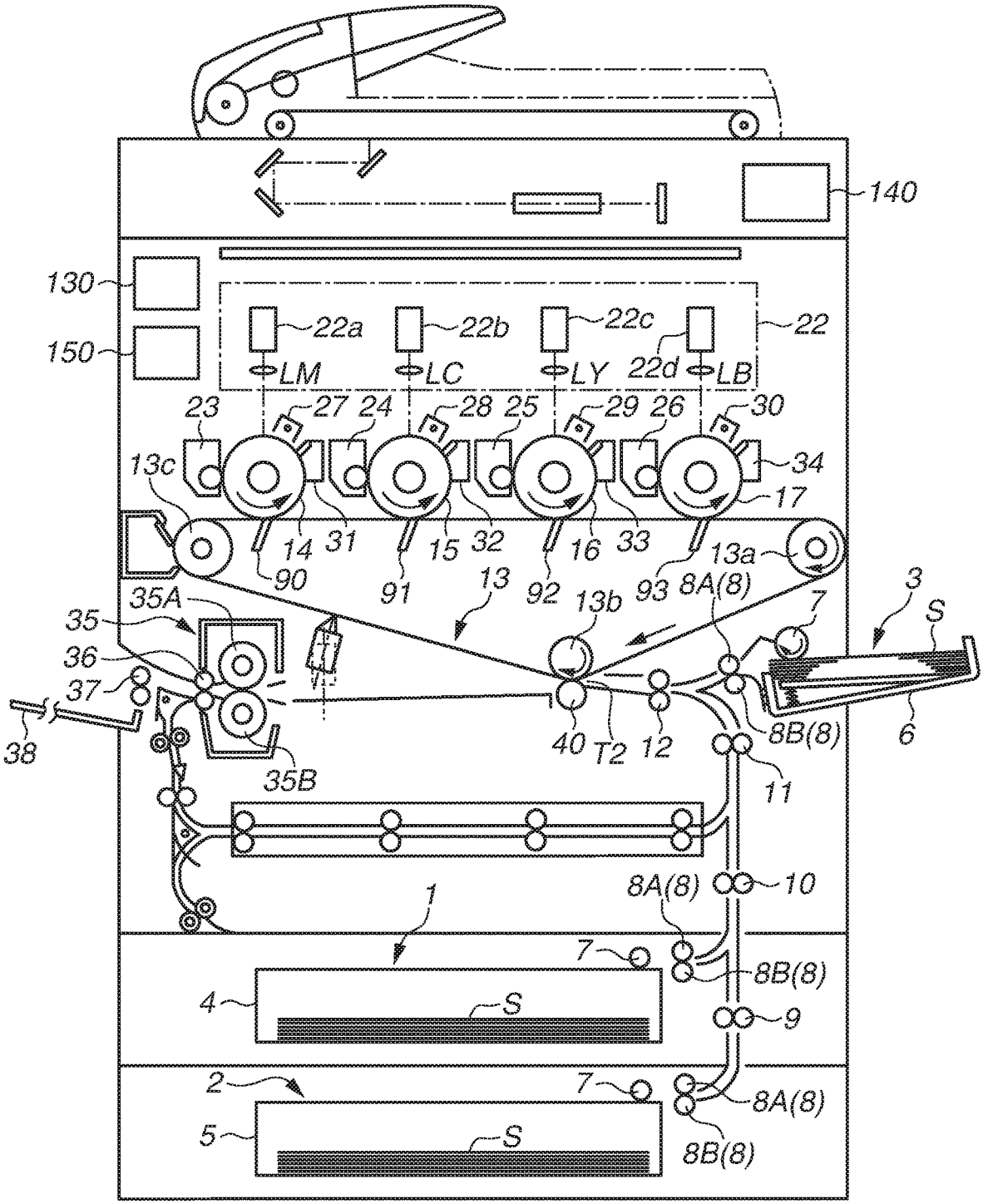
FIG. 1 is a cross-sectional view illustrating a configuration of an image forming apparatus in first and second exemplary embodiments.

Exemplary embodiments of the disclosure will be described in detail below with reference to the drawings. Prior to describing the exemplary embodiments, a problem in the detection of an abnormality in an optical scanning device will be described below. An optical scanning device for use in an electrophotographic image forming apparatus uses a rotary polygon mirror which is driven by a scanner motor to deflect laser light, with which a photosensitive member is scanned. The number of rotations of the scanner motor is, for example, expressed by the following relation formula.

$$RPM=((PS\times 60)\times(DPI/25.4))/(M\times N),$$

where

RPM: the number of rotations of the scanner motor (which is also the number of rotations of the rotary polygon mirror) per minute, PS: the movement speed (processing speed) per second on the surface of the photosensitive member in a direction that is substantially orthogonal to a scan direction of the laser light, DPI: the resolution (the number of dots per inch (25.4 mm)), N: the number of faces of the rotary polygon mirror, and M: the number of laser beams of a light source.

From this formula, it is understood that attempts to increase the number of rotations of the scanner motor have been made to improve productivity (processing speed) and resolution (dots per inch (DPI)) to obtain better image quality in recent years.

Meanwhile, it takes a predetermined activation time for the scanner motor to reach a target rotation number from a stopped state. The activation time increases as the number of rotations is increased, and this causes a problem of an increase (prolongation) in the first print out time which passes from the time of an instruction to start printing until print and discharge of the first recording sheet. To prevent an increase in the first print out time, an arrangement is made in which the supply of current to the scanner motor is increased to increase the rotation torque at the time of the activation so that the activation time is shortened.

In a power source device that supplies power to the scanner motor, the output current to a load increases, so that the power source capacity needs to be increased. If the power source capacity is increased, an overcurrent that flows in the load when an abnormality occurs also increases. Thus, an overcurrent protection circuit is provided to reduce the output current if an overcurrent is detected. For the safety of a connected load-side apparatus, a drooping characteristic that a limiter current continues to flow after an overcurrent is detected, a fold-back type drooping characteristic that the current is decreased during an abnormality, a shut-down characteristic that the supply of current is stopped during an abnormality, etc. are used as the protection characteristics of the overcurrent protection circuit.

Further, there is an inline color image forming apparatus including an image forming portion for each toner color. Such an image forming apparatus may be provided with an optical scanning device for each photosensitive member to expose the plurality of photosensitive members. The optical scanning device includes a rotary polygon mirror for deflecting laser light for exposing the photosensitive member and a scanner motor for rotating the rotary polygon mirror. For example, photosensitive members of image forming portions of four colors which are yellow, magenta, cyan, and black are exposed by the respective optical scanning devices. Such an image forming apparatus includes four scanner motors in total. The image forming apparatus starts forming an image after the scanner motors of the optical scanning devices reach a target rotation speed. At this time, in order to reduce the first print out time, all the four scanner motors need to be activated at the same time although yellow, magenta, cyan, and black images are to be formed in this order on the respective photosensitive members. The activation time of the scanner motors varies depending on the temperature, power source voltage, individual variation, etc. Thus, the image forming is started after it is confirmed that all the scanner motors reach the target rotation speed, whereby the timings to form images of the respective colors are synchronized to align the respective colors. In the case in which the four scanner motors are activated at substantially the same time to reduce the first print out time as described above, the amount of current that needs to be supplied from the power source device is four times the amount of current that needs to be supplied to activate a single scanner motor. Thus, the overcurrent protection circuit is likely to operate in the activation of the scanner motors, and there can be a case in which the optical scanning device is not activated normally due to lack of supply of necessary power.

Next, a problem will be described below that arises in the error display that is notified when the optical scanning device is not activated normally. As described above, it takes the predetermined activation time for the scanner motor to reach the constant target rotation speed from the stopped state. The following describes the control in the activation of the scanner motor. First, if a start signal which is an instruction to start printing is input, a control unit of the image forming apparatus causes the scanner motor in the stopped state to start rotating at full speed. In general, a motor used in the scanner motor is a three-phase brushless motor and includes a Hall element which detects a change in magnetic flux of a magnetic pole provided in a rotor to detect the location of the rotor. Then, the rotation speed of the scanner motor is detected based on a frequency generator (FG) signal which is a rotor location detection signal output when the Hall element detects a change in magnetic flux. Then, if the rotation speed of the scanner motor that is detected based on the FG signal reaches a predetermined speed range, the lighting of a laser (emission of laser light) from the light source is started. The lighting of the laser is started such that a beam detector (BD) signal, which is a writing detection signal for scanning the photosensitive member, is output from a BD which detects the laser light. The BD signal is more accurate as a signal for the detection of the rotation speed than the FG signal, so that after the BD signal is detected, the speed of the scanner motor is controlled based on the BD signal to control the rotation speed with greater accuracy. Next, the phase of the BD signal is controlled to align the writing positions of the respective colors (respective photosensitive members). The BD signal is a signal for detecting the writing position of the rotary polygon mirror, so that the phase control circuit performs phase control by using as a phase control reference signal a clock signal generated in advance for each color. Thus, the phases of the rotary polygon mirrors of the respective colors are brought into line with each other. Then, if the phase control circuit detects that the phases of the reference signal and the BD signal are brought into line, the phase control circuit outputs a phase lock signal, and if the control unit of the image forming apparatus detects the phase lock signal, the control unit starts forming an image.

Further, the control unit of the image forming apparatus measures the time between the start of the rotation of the scanner motor and the output of the phase lock signal. If no phase lock signal is output within a predetermined time, the control unit determines that an abnormality has occurred in the scanner motor, performs error display, and stops the image forming operation. At this time, the error display is showing the abnormality in the scanner motor. The abnormality may occur not in the scanner motor. For example, no BD signal may be output due to an abnormality in a laser diode or an abnormality may occur in the output voltage of the power source device. However, since the error display shows the abnormality in the scanner motor, the operator or serviceman normally misunderstands that the abnormality occurs in the scanner motor. There can be cases in which the display indicates that the abnormality occurs in the scanner motor when the abnormality occurs in the power source device, and this leads to a problem that it takes a significant amount of time and effort for the operator or serviceman to determine the cause of the abnormality in the optical scanning device and remove the cause.

[Structure of Image Forming Apparatus]

The following describes a first exemplary embodiment. FIG. 1 illustrates an image forming apparatus configured to acquire color images according to the first exemplary embodiment. The image forming apparatus and the image forming will schematically be described below with reference to FIG. 1. The color image forming apparatus includes two cassette sheet feeding portions 1 and 2 and a manual sheet feeding portion 3. A transfer sheet S which is a recording medium is selectively fed from the cassette sheet feeding portion 1 or 2 or the manual sheet feeding portion 3 (hereinafter, simply referred to as "sheet feeding portion 1, 2, or 3"). The transfer sheets S are stacked in a cassette 4 of the sheet feeding portion 1 or a cassette 5 of the sheet feeding portion 2 or on a tray 6 of the manual sheet feeding portion 3, and an uppermost transfer sheet S is picked up and conveyed toward a conveyance path one after another by a pick-up roller 7. Only the uppermost one of the transfer sheets S picked up and conveyed by the pick-up roller 7 is separated by a pair of separation rollers 8 including a feed roller 8A as a conveyance member and a retardation roller 8B as a separation unit. Thereafter, the transfer sheet S is conveyed to a pair of registration rollers 12, which have stopped rotating. In this case, the transfer sheet S that is fed from the cassette 4 or 5 located at a greater distance from the pair of registration rollers 12 is conveyed to the pair of registration rollers 12 through a plurality of pairs of conveyance rollers 9, 10, and 11. The leading edge of the transfer sheet S conveyed to the pair of registration rollers 12 hits a nip portion of the pair of registration rollers 12 to form a predetermined loop, and the movement is stopped. The loop is formed to correct a skew state of the transfer sheet S.

Downstream (hereinafter, simply referred to as "downstream") of the pair of registration rollers 12 in the conveyance direction of the transfer sheet S is provided an intermediate transfer belt 13 which is a long intermediate transfer member. The intermediate transfer belt 13 is stretched tightly by a driving roller 13*a*, a secondary transfer counter roller 13*b*, and a tension roller 13*c* to form a substantially triangular shape when seen in cross section. The intermediate transfer belt 13 is rotated clockwise in FIG. 1. On the top surface of a horizontal portion of the intermediate transfer belt 13 are disposed photosensitive drums 14, 15, 16, and 17 next to each other along the rotation direction of the intermediate transfer belt 13. The photosensitive drums 14, 15, 16, and 17 are configured to form and bear color toner images of different colors. The photosensitive drum 14 located in the most upstream position in the rotation direction of the intermediate transfer belt 13 bears a magenta (M) toner image. The next photosensitive drum 15 bears a cyan (C) toner image. The next photosensitive drum 16 bears a yellow (Y) toner image. Further, the photosensitive drum 17 located in the most downstream position in the rotation direction of the intermediate transfer belt 13 bears a black (B) toner image.

Above the photosensitive drums 14, 15, 16, and 17 is provided an optical scanning device 22 (displayed in the frame portion by a long dashed short dashed line in FIG. 1) which is an exposure device. In the optical scanning device 22, exposure portions 22*a*, 22*b*, 22*c*, and 22*d* which respectively emit laser light beams LM, LC, LY, and LB to form electrostatic latent images are provided to face the photosensitive drums 14, 15, 16, and 17, respectively. Details of the optical scanning device 22 will be described below.

The image forming apparatus in FIG. 1 forms an image as follows. First, exposure of the photosensitive drum 14 (the photosensitive member), which is located in the most upstream position of the intermediate transfer belt 13 to the laser light beam (also a light beam) LM based on a magenta component image is started to form an electrostatic latent image on the photosensitive drum 14. The electrostatic latent image formed on the photosensitive drum 14 is visualized with a magenta toner supplied from a development device 23. Next, after a predetermined time passes from the initiation of the exposure to the laser light beam LM on the photosensitive drum 14, exposure of the photosensitive drum 15 to the laser light beam LC based on a cyan component image is started to form an electrostatic latent image on the photosensitive drum 15. The electrostatic latent image formed on the photosensitive drum 15 is visualized with a cyan toner supplied from a development device 24. Then, after a predetermined time passes from the initiation of the exposure of the photosensitive drum 15 to the laser light beam LC, exposure of the photosensitive drum 16 to the laser light beam LY based on a yellow component image to is started to form an electrostatic latent image on the photosensitive drum 16. The electrostatic latent image formed on the photosensitive drum 16 is visualized with a yellow toner supplied from a development device 25. Lastly, after a predetermined time passes from the initiation of the exposure of the photosensitive drum 16 to the laser light beam LY, the exposure of the photosensitive drum 17 to the laser light beam LB based on a black component image is started to form an electrostatic latent image on the photosensitive drum 17. The electrostatic latent image formed on the photosensitive drum 17 is visualized with a black toner supplied from a development device 26. Primary charging devices 27, 28, 29, and 30 for uniformly charging the photosensitive drums 14 to 17 are provided around the photosensitive drums 14 to 17, respectively. Further, cleaners 31, 32, 33, and 34 for removing the toners remaining on the photosensitive drums 14 to 17 after the toner images are transferred are also provided.

During the clockwise rotation of the intermediate transfer belt 13, the intermediate transfer belt 13 passes through a transfer portion between the photosensitive drum 14 and a transfer charging device 90 to transfer the magenta toner image onto the intermediate transfer belt 13. Next, the intermediate transfer belt 13 passes through a transfer portion between the photosensitive drum 15 and a transfer charging device 91 to transfer the cyan toner image onto the intermediate transfer belt 13. Then, the intermediate transfer belt 13 passes through a transfer portion between the photosensitive drum 16 and a transfer charging device 92 to transfer the yellow toner image onto the intermediate transfer belt 13. Lastly, the intermediate transfer belt 13 passes through a transfer portion between the photosensitive drum 17 and a transfer charging device 93 to transfer the black toner image onto the intermediate transfer belt 13. The respective color toner images are transferred from the photosensitive drums 14 to 17 onto the intermediate transfer belt 13 at appropriate timing, and the magenta, cyan, yellow, and black toner images are transferred and superimposed on the intermediate transfer belt 13.

Meanwhile, the transfer sheet S is conveyed to the pair of registration rollers 12 to correct the skew state. The pair of registration rollers 12 starts rotating at timing, which aligns the positions of the toner images on the intermediate transfer belt 13 with the leading edge of the transfer sheet S. Next, the transfer sheet S is conveyed by the pair of registration rollers 12 to a transfer portion T2 which is a contact portion of a secondary transfer roller 40 and the secondary transfer counter roller 13*b* on the intermediate transfer belt 13 to transfer the toner images onto the transfer sheet S. The transfer sheet S having passed through the transfer portion T2 is conveyed to a fixing device 35. Then, while passing through a nip portion formed by a fixing roller 35A and a pressing roller 35B in the fixing device 35, the transfer sheet S is heated by the fixing roller 35A and pressed by the pressing roller 35B to fix the toner images to the transfer sheet S. The transfer sheet S having undergone the fixing processing and having passed through the fixing device 35 is conveyed by a pair of conveyance rollers 36 to a pair of discharge rollers 37 and then discharged onto a discharge tray 38 located outside the apparatus. The color image forming apparatus in FIG. 1 is a mere example and can be, for example, a monochrome image forming apparatus and is not limited to the structure described in the present exemplary embodiment.

A control unit 130 controls the apparatuses to perform image forming operations described above. A power source device 150 generates a direct current (DC) of 5 V to be supplied to control systems, such as the control unit 130 and a controller 114 described below, and a DC of 24 V to be supplied to the load of a driving system such as a motor. Further, an upper portion of the image forming apparatus includes an operation unit 140 including an input portion for data input and a display section for displaying information.

[Structure of Optical Scanning Apparatus]

Figure 2:
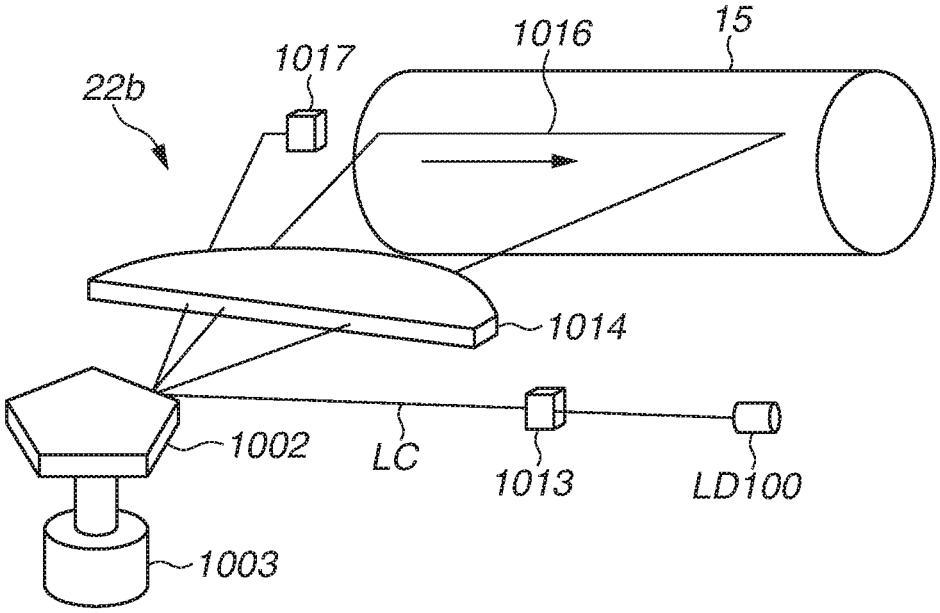
FIG. 2 schematically illustrates a main portion of an optical scanning device in the first and second exemplary embodiments.

FIG. 2 schematically illustrates the structure of an optical scan system of the exposure portion of a single color in the optical scanning device 22 in FIG. 1 and the vicinity of the optical scan system. The optical scanning device 22 includes the exposure portions 22*a*, 22*b*, 22*c*, and 22*d* of four colors, and the structures and operations of the exposure portions 22*a*, 22*b*, 22*c*, and 22*d* are similar. The following describes the operations of the exposure portion 22*b* which forms an electrostatic latent image on the photosensitive drum 15 on which a cyan image is formed.

As illustrated in FIG. 2, the image forming apparatus illustrated in FIG. 1 is provided with the optical scanning device 22 including the exposure portion 22*b*. The exposure portion 22*b* irradiates the photosensitive drum 15 to the laser light beam LC to form on the photosensitive drum 15 an electrostatic latent image corresponding to input image data. The optical scanning device 22 includes a laser light source laser diode (LD) 100 which emits 16-beam laser light, and a plurality of laser light beams emitted from the laser light source LD 100 is changed into the parallel laser light beam LC via a collimator lens 1013. The laser light beam LC enters a reflection surface of a rotary polygon mirror 1002 which is a deflection apparatus driven and rotated by a scanner motor 1003. Then, the rotary polygon mirror 1002 reflects the laser light beam LC incident on the reflection surface such that the incident laser light beam LC is scanned over the photosensitive drum 15. The laser light beam LC reflected by the rotary polygon mirror 1002 transmits through an Fθ lens 1014 and is scanned over the surface of the photosensitive drum 15 in a main scan direction (direction specified by an arrow in FIG. 2) at a constant speed. As a result of the scan with the laser light beam LC, an electrostatic latent image 1016 is formed on the photosensitive drum 15.

At the timing that corresponds to the initiation of scanning of the laser light beam LC over the photosensitive drum 15, the laser light source LD 100 is forcibly lit, and the laser light beam LC reflected by the rotary polygon mirror 1002 enters a beam detector 1017 (hereinafter, "BD 1017"). The BD 1017 detects the laser light beam LC that is reflected by the rotary polygon mirror 1002 and input during the forcible lighting period of the laser light source LD 100, and outputs a beam detection signal (hereinafter, "BD signal") which is to be a reference signal of the image writing timing of the main scan direction.

[Control of Driving Motor of Optical Scanning Device]

Figure 3:
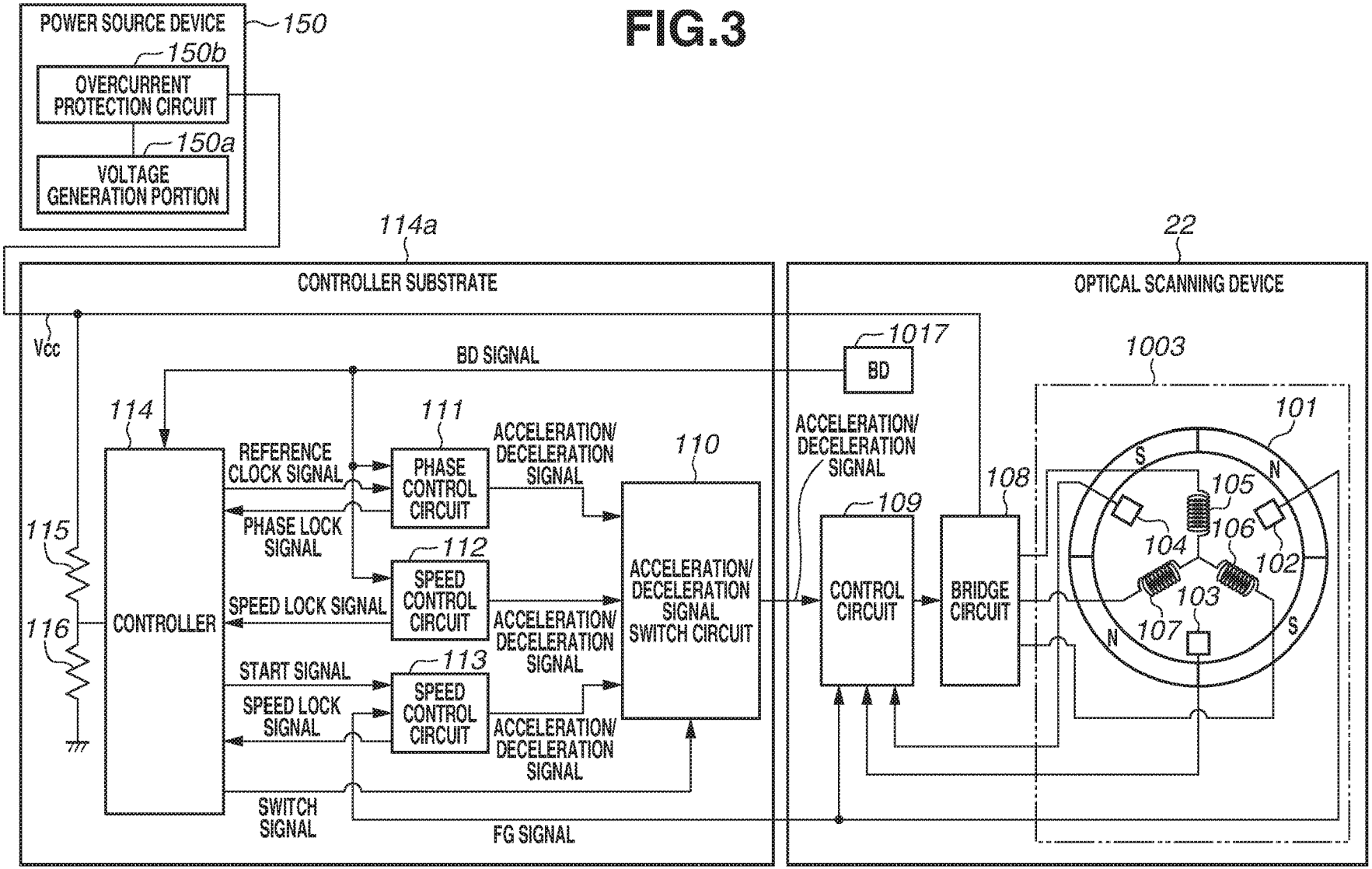
FIG. 3 is a block diagram illustrating scanner motor control in the first and second exemplary embodiments.

FIG. 3 is a block diagram illustrating control of the scanner motor 1003 of the optical scanning device 22. FIG. 3 illustrates the control relationship between the power source device 150, which supplies power, the controller 114, which controls the scanner motor 1003, a controller substrate 114*a* on which a speed control circuit and a phase control circuit are mounted, and the optical scanning device 22 on which the scanner motor 1003 and a control circuit 109 are mounted. In the present exemplary embodiment, the controller 114 is provided with respect to each of the exposure portions 22*a*, 22*b*, 22*c*, and 22*d* of the optical scanning device 22.

As illustrated in FIG. 3, the optical scanning device 22 includes the scanner motor 1003, the control circuit 109, a bridge circuit 108, and the BD 1017. Further, the scanner motor 1003 includes a rotor 101 which is a rotor portion, and the rotary polygon mirror 1002 illustrated in FIG. 2 is provided on the rotor 101, which rotates together with the rotor 101. The scanner motor 1003 is a three-phase, four-pole brushless DC motor. A magnet with two sets of magnetic poles (north pole, south pole) arranged is attached to the rotor 101. The rotor 101 is rotated by a rotation magnetic field generated by field coils 105, 106, and 107, and as the rotor 101 is rotated, the rotary polygon mirror 1002 on the rotor 101 is also rotated.

When the scanner motor 1003 is rotated (i.e., when the rotor 101 is rotated), the magnetic flux around Hall elements 102, 103, and 104 changes. The Hall elements 102, 103, and 104, which are a signal generation device, detect a change in magnetic flux magnetized by the rotor 101 being rotating, and outputs a detection signal to the control circuit 109. The control circuit 109 detects the positions of the magnetic poles of the magnet of the rotor 101 from the detection signal output from the Hall elements 102, 103, and 104, and outputs a driving signal to the bridge circuit 108 so that a rotation magnetic field corresponding to the positions of the magnetic poles is generated. The bridge circuit 108 supplies the field coils 105, 106, and 107 of the scanner motor 1003 with a voltage Vcc (DC 24 V) supplied from the power source device 150 in response to the driving signal input from the control circuit 109. In the optical scanning device 22, as described above, the positions of the magnetic poles of the rotor 101 are detected based on the output from the Hall elements 102, 103, and 104, and the supply of power to the field coils 105, 106, and 107 is switched at an optimal timing by the control circuit 109. Consequently, the scanner motor 1003 generates a rotation magnetic field, and the rotor 101 is driven and rotated.

The controller substrate 114*a* of the controller 114 mounted on the controller substrate 114*a* is provided with an acceleration/deceleration signal switch circuit 110, a phase control circuit 111, speed control circuits 112 and 113, and the controller 114. The controller 114, which is an integrated circuit, controls the acceleration/deceleration signal switch circuit 110, the phase control circuit 111, and the speed control circuits 112 and 113 to control the scanner motor 1003. Further, the controller 114 includes a timer (not illustrated) for measuring the time. The output of the Hall element 102 is also supplied to the speed control circuit 113 as a FG signal (rotation period signal). The frequency of the FG signal is proportional to the rotation speed of the rotor 101. Thus, the rotation speed of the scanner motor 1003 is controllable by controlling the power supply to the scanner motor 1003 to adjust the frequency of the FG signal to a predetermined frequency corresponding to a target rotation speed of the scanner motor 1003. The speed control circuit 113 generates an acceleration signal or a deceleration signal (hereinafter, "acceleration/deceleration signal") based on the rotation speed calculated from the FG signal to adjust the rotation speed of the scanner motor 1003 to the target rotation speed, and outputs the generated signal to the acceleration/deceleration signal switch circuit 110. Further, if the speed control circuit 113, which is a rotation detection member, detects that the rotation speed of the scanner motor 1003 detected based on the FG signal reaches into a predetermined rotation speed range, the speed control circuit 113 outputs a speed lock signal (first lock signal) to the controller 114. When the scanner motor 1003 is activated, the controller 114 outputs a start signal to the speed control circuit 113 and outputs to the acceleration/deceleration signal switch circuit 110 a switch signal to give an instruction to output to the optical scanning device 22 the acceleration/deceleration signal from the speed control circuit 113. In this way, the acceleration/deceleration signal for driving the scanner motor 1003 is output from the acceleration/deceleration signal switch circuit 110 to the control circuit 109 of the optical scanning device 22, and the scanner motor 1003 starts rotating. The controller 114 can be an integrated circuit in which at least one of the phase control circuit 111, the speed control circuit 112, the speed control circuit 113, and the acceleration/deceleration signal switch circuit 110 is built.

Further, the BD signal output from the BD 1017, which is a light beam detection sensor, is supplied to the speed control circuit 112, the phase control circuit 111, and the controller 114. The BD signal which is a detection signal is proportional to the rotation speed of the rotor 101, as is the same with the FG signal output from the Hall element 102, etc., so that the BD signal is a signal for detecting the rotation speed of the scanner motor 1003. Thus, the speed control circuit 112, which is a rotation detection unit, generates the acceleration/deceleration signal based on the rotation speed calculated from the BD signal to adjust the rotation speed of the scanner motor 1003 to the target rotation speed, and outputs the acceleration/deceleration signal to the acceleration/deceleration signal switch circuit 110. Further, if the speed control circuit 112 detects that the rotation speed of the scanner motor 1003 detected based on the BD signal reaches into a predetermined rotation speed range, the speed control circuit 112 outputs a speed lock signal (second lock signal) to the controller 114. The predetermined rotation speed of the scanner motor 1003 in the case where the speed control circuit 113 outputs the speed lock signal is a different rotation speed from the predetermined rotation speed of the scanner motor 1003 in the case where the speed control circuit 112 outputs the speed lock signal. The phase control circuit 111 compares the phase of a reference clock signal output from the controller 114 with the phase of the BD signal, generates an acceleration/deceleration signal of the scanner motor 1003 such that the phases of the two signals match, and outputs the generated acceleration/deceleration signal to the acceleration/deceleration signal switch circuit 110. Further, if the phase difference between the reference clock signal and the BD signal reaches into a predetermined range, the phase control circuit 111, which is a phase control unit, outputs a phase lock signal (third lock signal) to the controller 114. The phase lock signal is output to the controller 114 in the case where the phase difference between the reference clock signal and the BD signal is within the predetermined range.

The controller 114 detects the state of the scanner motor 1003 based on the phase lock signal output from the phase control circuit 111 and the speed lock signal output from the speed control circuit 112 or 113. Then, the controller 114 outputs to the acceleration/deceleration signal switch circuit 110 a switch signal to give an instruction to output the acceleration/deceleration signal from the speed control circuit 112 or the speed control circuit 113 based on the detection result. The acceleration/deceleration signal switch circuit 110 outputs to the control circuit 109 of the optical scanning device 22 the acceleration/deceleration signal output from the speed control circuit 112 or 113 in response to the switch signal output from the controller 114. The control circuit 109 of the optical scanning device 22 controls the driving state of the scanner motor 1003 in the bridge circuit 108 based on the input acceleration/deceleration signal and controls the amount of power supply to the field coils 105, 106, and 107 to control the rotation speed of the scanner motor 1003. Further, in order to detect the state of a power source voltage Vcc (DC 24 V) supplied to the optical scanning device 22, the controller 114 inputs a voltage obtained by dividing a power source voltage Vcc at voltage dividing resistors 115 and 116, which are a voltage detection unit (sensor), to detect the state of the power source voltage.

The power source device 150 in the present exemplary embodiment is attached to the main body of the image forming apparatus. The power source device 150 includes a voltage generation portion 150*a* and an overcurrent protection circuit 150*b*. The voltage generation portion 150*a* generates a DC (direct current voltage) of 5 V to be supplied to a control circuit such as the controller 114 and a DC of 24 V to be supplied to a driving system such as the scanner motor 1003. The overcurrent protection circuit 150*b* detects the electric current value of the power source voltage (DC 24 V) supplied to the optical scanning device 22, and if the overcurrent protection circuit 150*b* detects that a current not less than a predetermined electric current value is supplied to the optical scanning device 22, etc., the overcurrent protection circuit 150*b* blocks the supply of current or decreases the electric current value. In this way, the supply of an overcurrent to the optical scanning device 22, which is a load, is prevented.

[Sequence of Activation of Optical Scanning Apparatus]

Figure 4:
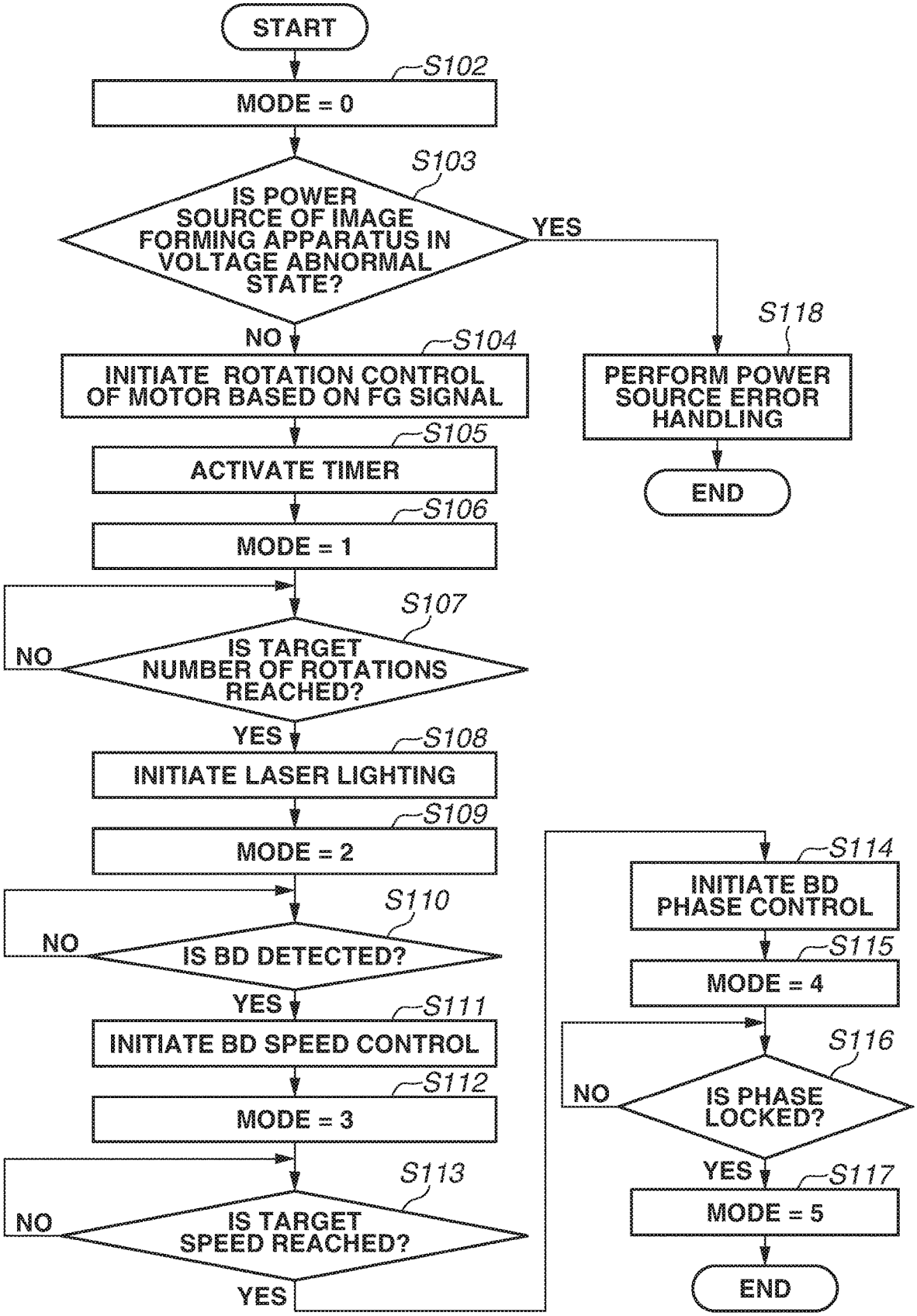
FIG. 4 is a flowchart illustrating a sequence of activating a scanner motor in the first exemplary embodiment.

Next, the control during the activation of the scanner motor 1003 in image forming will be described below. FIG. 4 is a flowchart illustrating a sequence of control in the activation of the scanner motor 1003 of the optical scanning device 22 to cause the image forming apparatus to perform an image forming operation. The process illustrated in FIG. 4 is activated when the image forming apparatus performs an image forming operation, and is executed by the controller 114.

In step S102, the controller 114 sets a variable MODE, which indicates a control mode for the activation of the optical scanning device 22, to "0", which indicates an initial state. In step S103, prior to the activation of the scanner motor 1003, the controller 114 determines whether a power source voltage is in an abnormal state where the voltage obtained by dividing the power source voltage Vcc at the voltage dividing resistors 115 and 116 and input to the controller 114 is lower than a predetermined voltage. If the controller 114 determines that the input voltage is lower than the predetermined voltage (if the power source voltage is in the abnormal state) (YES in step S103), the processing proceeds to step S118. On the other hand, if the controller 114 determines that the input voltage is not lower than the predetermined voltage (if the power source voltage is not in the abnormal state) (NO in step S103), the processing proceeds to step S104. In step S118, the controller 114 performs next power source error processing. The controller 114 notifies the control unit 130 that a power source error has occurred, and the control unit 130 indicates on a display section of the operation unit 140 (i.e., a user interface) a power source error occurrence, which notifies an abnormality of the power source device 150, and stops the print initiation operation, and the process is ended.

In step S104, the controller 114 starts controlling the rotation of the scanner motor 1003 of the optical scanning device 22 based on the FG signal (motor FG rotation control initiation). Thus, the controller 114 outputs a start signal to the speed control circuit 113 to cause the speed control circuit 113 to output an acceleration/deceleration signal. Further, the controller 114 outputs to the acceleration/deceleration signal switch circuit 110 a switch signal to give an instruction to output the acceleration/deceleration signal from the speed control circuit 113 which controls the speed of the scanner motor 1003 based on the FG signal. In step S105, the controller 114 resets and starts the timer to monitor whether the processing of activating the scanner motor 1003 ends within a predetermined time (timer activation). In step S106, the controller 114 sets the variable MODE to "1", which indicates a FG rotation mode.

In step S107, the controller 114 determines whether the scanner motor 1003 reaches a target rotation speed (first target rotation speed) ("IS TARGET NUMBER OF ROTATIONS REACHED?") based on whether a speed lock signal is output from the speed control circuit 113 which controls the scanner motor 1003. If an output of a speed lock signal from the speed control circuit 113 is detected, the controller 114 determines that the scanner motor 1003 has reached the target rotation speed (YES in step S107), and the processing proceeds to step S108. On the other hand, if no output of a speed lock signal is detected from the speed control circuit 113, the controller 114 determines that the scanner motor 1003 has not reached the target rotation speed (NO in step S107), and the processing proceeds to step S107. In step S108, the controller 114 controls the laser light source LD 100 of the optical scanning device 22 to initiate laser light emission from the laser light source LD 100 (laser lighting initiation). In step S109, the controller 114 sets the variable MODE to "2", which indicates a laser control mode, to change the control mode.

In step S110, the controller 114 determines whether the laser light is input to the BD 1017 and the BD 1017 outputs a BD signal ("IS BD DETECTED?"). If the controller 114 determines that an input of the BD signal from the BD 1017 is detected (YES in step S110), the processing proceeds to step S111. On the other hand, if the controller 114 determines that no BD signal from the BD 1017 is detected (NO in step S110), the processing returns to step S110. In step S111, the controller 114 starts controlling the speed of the scanner motor 1003 based on the BD signal (BD speed control initiation). Thus, the controller 114 outputs to the acceleration/deceleration signal switch circuit 110 a switch signal to give an instruction to output the acceleration/deceleration signal from the speed control circuit 112 which controls the speed of the scanner motor 1003 based on the BD signal. In step S112, the variable MODE is set to "3", which indicates the BD speed control mode, to change the control mode.

In step S113, the controller 114 determines whether the scanner motor 1003 has reached a target rotation speed (second target rotation speed) ("IS TARGET SPEED REACHED?") based on whether a speed lock signal is output from the speed control circuit 112 which controls the scanner motor 1003 based on the BD signal. If a speed lock signal from the speed control circuit 112 is detected, the controller 114 determines that the scanner motor 1003 has reached the target rotation speed (YES in step S113), and the processing proceeds to step S114. On the other hand, if no speed lock signal from the speed control circuit 112 is detected, the controller 114 determines that the scanner motor 1003 has not reached the target rotation speed (NO in step S113), and the processing returns to step S113. In step S114, the controller 114 starts controlling the phase of the scanner motor 1003 based on the BD signal (BD phase control initiation). In step S115, the variable MODE is set to "4", which indicates the BD phase control mode, to change the control mode.

In step S116, the controller 114 determines whether the phase of the BD signal matches with the phase of the reference clock signal of the exposure portion 22*d* for black (B) ("IS PHASE LOCKED?") depending on whether a phase lock signal is output from the phase control circuit 111, so that the phases match with each other. If a phase lock signal from the phase control circuit 111 is detected, the controller 114 determines that the phase of the BD signal matches with the phase of the reference clock signal (YES in step S116), and the processing proceeds to step S117. On the other hand, if no phase lock signal from the phase control circuit 111 is detected, the controller 114 determines that the phase of the BD signal does not match with the phase of the reference clock signal (NO in step S116), and the processing returns to step S116. In step S117, the controller 114 sets the variable MODE to "5", which indicates the BD phase lock mode, to change the control mode, and the process is ended. Thereafter, the controller 114 initiates printing to form an image on the transfer sheet S.

[Error Monitoring during Activation of Optical Scanning Device]

Figure 5:
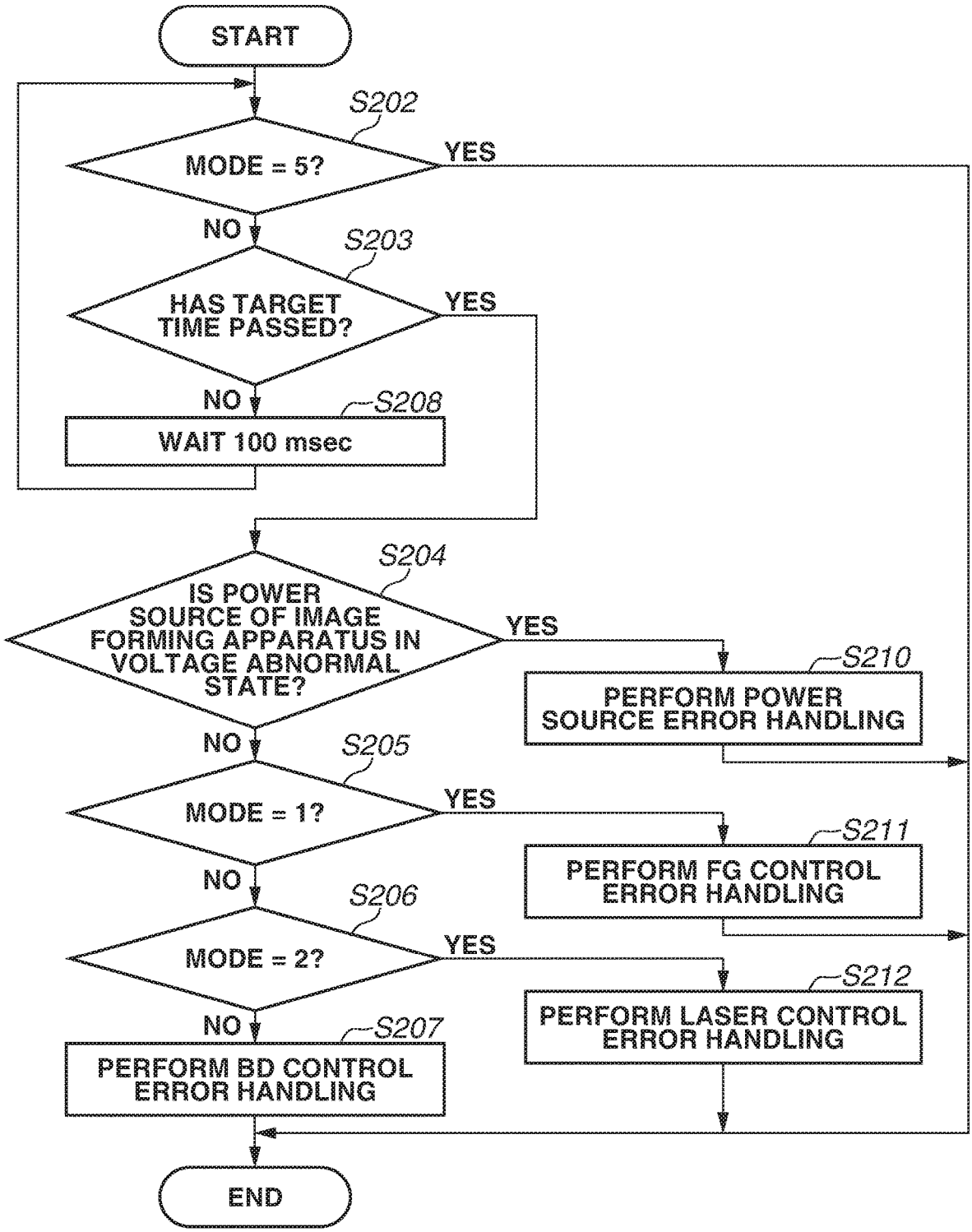
FIG. 5 is a flowchart illustrating a sequence of monitoring an activation state of the scanner motor in the first exemplary embodiment.

Next, a process of monitoring whether the processing of activation of the scanner motor 1003 which is described above with reference to FIG. 4 is ended normally within a predetermined time will be described below. FIG. 5 is a flowchart illustrating a control sequence for monitoring the activation state of the scanner motor 1003 of the optical scanning device 22. If the timer is activated by the processing in step S105 in FIG. 4, the process illustrated in FIG. 5 is executed periodically (e.g., every 100 msec (milliseconds)) by the controller 114 in parallel with the process illustrated in FIG. 4.

In step S202, the controller 114 determines whether the set value of the variable MODE is "5" (BD phase lock mode) (MODE=5?). If the controller 114 determines that the set value of the variable MODE is "5" (YES in step S202), the scanner motor 1003 of the optical scanning device 22 is normally activated, therefore, the process is ended. On the other hand, if the controller 114 determines that the set value of the variable MODE is not "5" (NO in step S202), the processing proceeds to step S203. In step S203, the controller 114 refers to the timer activated in the processing in step S105 in FIG. 4 and determines whether a target time (first predetermined time) has passed, in which activating of the scanner motor 1003 of the optical scanning device 22 should end ("HAS TARGET TIME PASSED?"). If the controller 114 determines that the target time has passed (YES in step S203), the processing proceeds to step S204. On the other hand, if the controller 114 determines that the target time has not passed (NO in step S203), the processing proceeds to step S208. In step S208, the controller 114 stops the processing for 100 msec (milliseconds) (waits for 100 msec), and after 100 msec passes, the processing returns to step S202 to execute step S202. Alternatively, in place of the processing in step S208, a timer (different from the timer activated by the processing in step S105 in FIG. 4) may be reset and started, and it is determined whether the timer indicates that 100 msec have passed. If it is determined that 100 msec have passed, the processing returns to step S202.

In step S204, the controller 114 determines again whether the power source is in the voltage abnormal state in which the voltage obtained by dividing the power source voltage Vcc at the voltage dividing resistors 115 and 116 and input to the controller 114 is lower than a predetermined voltage ("IS POWER SOURCE OF IMAGE FORMING APPARATUS IN VOLTAGE ABNORMAL STATE?"). If the controller 114 determines that the input voltage is lower than the predetermined voltage (the image forming apparatus is in the power source voltage abnormal state) (YES in step S204), the processing proceeds to step S210. On the other hand, if the controller 114 determines that the input voltage is not lower than the predetermined voltage (the power source is not in the voltage abnormal state) (NO in step S204), the processing proceeds to step S205. In step S210, the controller 114 performs next power source error processing. The controller 114 notifies the control unit 130 of the occurrence of a power source error. The control unit 130 notifies the occurrence of a motor activation error on the display section of the operation unit 140, which indicates an abnormality in the activation of the scanner motor 1003, and a power source abnormal mode, which indicates the mode at the time of the occurrence of the abnormality, and stops the print initiation operation, and the process is ended.

In step S205, the controller 114 determines whether the value of the variable MODE is "1" (FG rotation control mode). If the controller 114 determines that the value of the variable MODE is "1" (YES in step S205), the processing proceeds to step S211. On the other hand, if the controller 114 determines that the value of the variable MODE is not "1" (NO in step S205), the processing proceeds to step S206. In step S211, the controller 114 performs next FG control error processing. The controller 114 notifies the control unit 130 of the occurrence of the FG control error. The control unit 130 indicates on the display section of the operation unit 140 the occurrence of a motor activation error and a FG rotation control abnormal mode, which indicates the mode at the time of the occurrence of the abnormality, and stops the print initiation operation, and the process is ended.

In step S206, the controller 114 determines whether the value of the variable MODE is "2" (laser control mode). If the controller 114 determines that the value of the variable MODE is "2" (YES in step S206), the processing proceeds to step S212. On the other hand, if the controller 114 determines that the value of the variable MODE is not "2" (NO in step S206), the processing proceeds to step S207. In step S212, the controller 114 performs next laser control error processing. The controller 114 notifies the control unit 130 of the occurrence of a laser control error. The control unit 130 displays on the display section of the operation unit 140 the occurrence of a motor activation error and a laser control abnormal mode, which indicates the mode at the time of the occurrence of the abnormality, and stops the print initiation operation, and the process is ended. In step S207, the controller 114 performs next BD control error processing. The controller 114 notifies the control unit 130 of the occurrence of a BD control error. The control unit 130 displays on the display section of the operation unit 140 the occurrence of a motor activation error and a BD control abnormal mode, which indicates the mode at the time of the occurrence of the abnormality, and stops the print initiation operation, and the process is ended.

[Error Code]

As described above, if an abnormality occurs during the activation of the optical scanning device 22, the controller 114 displays an error on the operation unit 140. Table 1 below shows examples of error codes of error information displayed on the operation unit 140.

TABLE 1

| Error Code | State |
|---|---|
| E1000 | Power Source Abnormal |
| E1010 | FB Control Abnormal |
| E1020 | Laser Control Abnormal |
| E1030 | BD Control Abnormal |

Table 1 includes an error code section and a state section which indicates an abnormal portion where an abnormality occurs and an abnormal state. Each error code indicated in the error code section is a hexadecimal 5-digit code. The error code E1000 indicates a power source voltage abnormality (displayed as "power source abnormal" in Table 1) in which the power source voltage from the power source device 150 is lower than a predetermined voltage. Further, the error code E1010 indicates an abnormality (displayed as "FB control abnormal" in Table 1) in which the scanner motor 1003 has not reached the target rotation speed in a FG control mode of the scanner motor 1003. Further, the error code E1020 indicates an abnormality (displayed as "laser control abnormal" in Table 1) in which no BD signal has been detected during the laser lighting in the laser control mode of the scanner motor 1003. Further, the lowest 4-digit code E1030 indicates an abnormality (displayed as "BD control abnormal" in Table 1) in which the scanner motor 1003 has not reached the target rotation speed or adjustment of the phases has failed after the target speed has been reached.

As described above, in the case where the abnormality occurs during the scanner motor activation, a notification of error information is issued such that an abnormality originating from the scanner motor and an abnormality originating from the power source device are differentiated based on the control mode at the time of the occurrence of the abnormality. This enables the operator to perform an appropriate operation to recover the optical scanning device from the abnormal state based on the error information specified in the notification. While the control of the 1-in-1 optical scanning device is described in the present exemplary embodiment, in which the exposure portion for scanning the photosensitive drum is provided corresponding to the photosensitive drum, the present exemplary embodiment is also applicable to, for example, a 2-in-1 or 4-in-1 optical scanning device. Further, while the color image forming apparatus is described as an example in the present exemplary embodiment, the present exemplary embodiment is also applicable to a monochrome image forming apparatus including only one photosensitive drum.

As described above, according to the present exemplary embodiment, a notification can be accurately issued that the optical scanning device is not activated due to an abnormality in the power source device of the image forming apparatus.

The following describes a second exemplary embodiment. In the first exemplary embodiment, the processing is described in which it is monitored whether the scanner motor of the optical scanning device is normally activated within a predetermined target time in the image forming and an error notification is issued if the scanner motor is not normally activated. In the second exemplary embodiment, the processing will be described below, in which an occurrence of an abnormality in the optical scanning device in the image forming apparatus is monitored after being normally activated. The structures of the image forming apparatus and the optical scanning device in the second exemplary embodiment are similar to those in the first exemplary embodiment, and the same reference numerals are used with respect to similar apparatuses to omit descriptions thereof.

[Monitoring of Abnormality after Activation of Optical Scanning Device]

Figure 6:
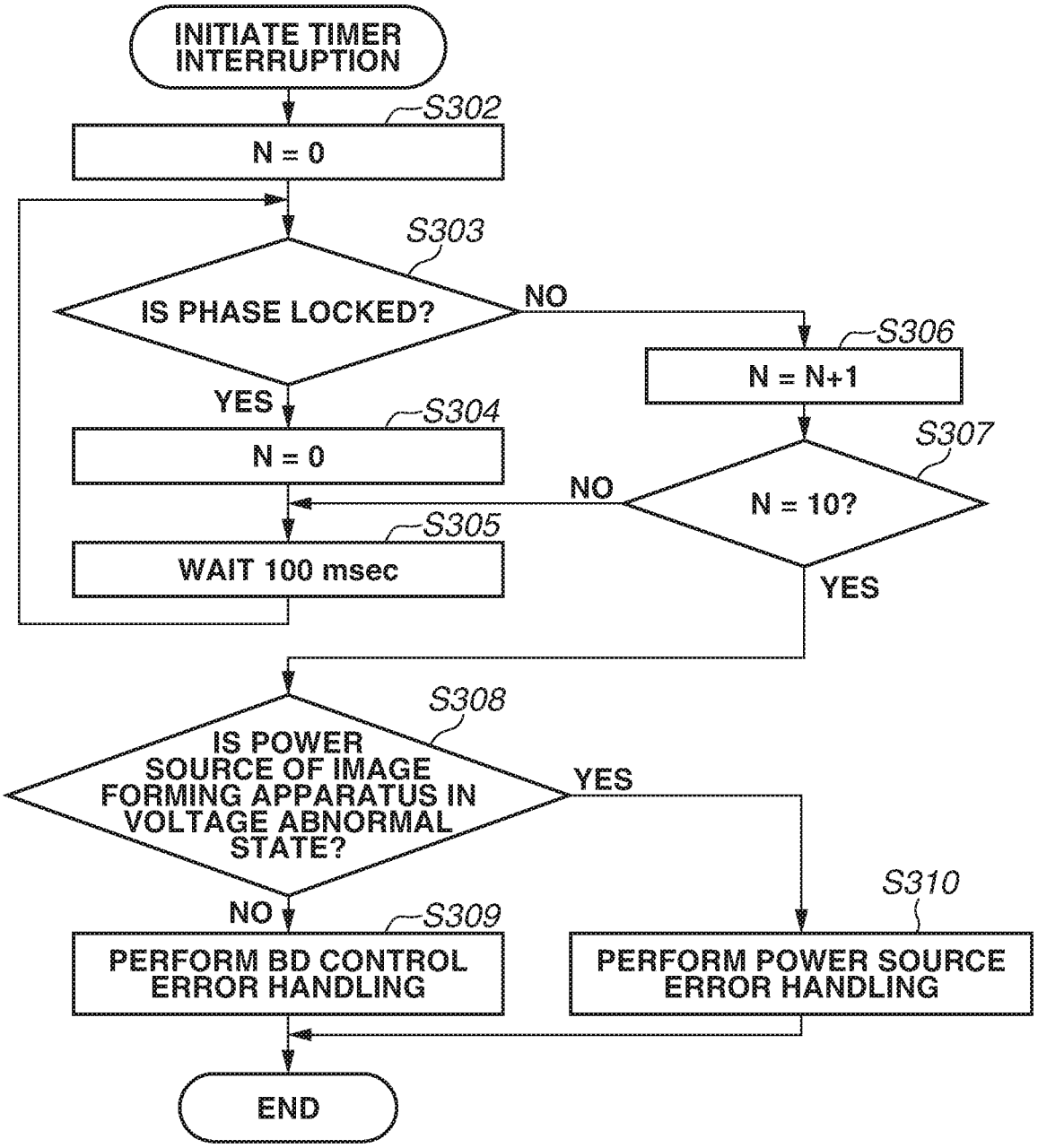
FIG. 6 is a flowchart illustrating a sequence of monitoring a rotation state after the scanner motor is activated in the second exemplary embodiment.
Figure 7:
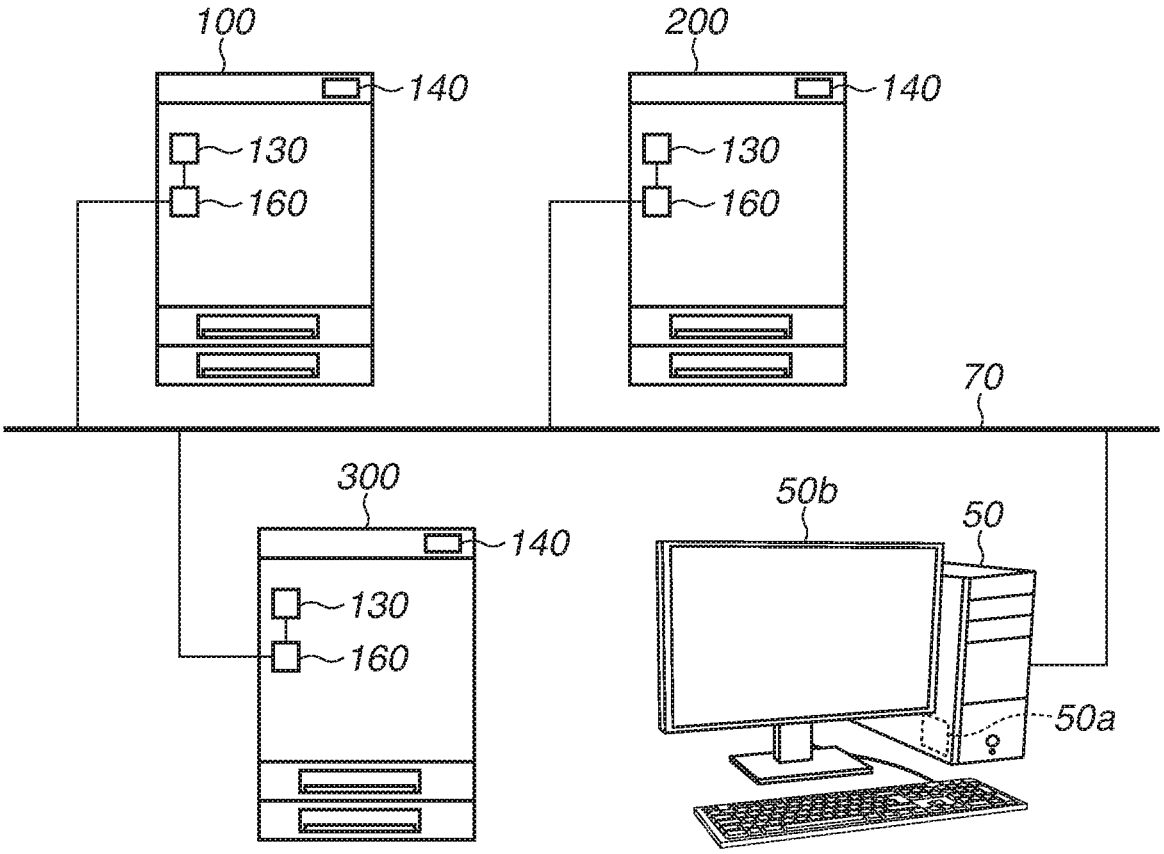
FIG. 7 illustrates a management system in the first and second exemplary embodiments.

FIG. 6 is a flowchart illustrating a control sequence for monitoring the operation state of the scanner motor 1003 of the optical scanning device 22. The process illustrated in FIG. 6 is activated after the scanner motor 1003 is activated and the phase control circuit 111 outputs a phase lock signal to the controller 114 and the image forming apparatus becomes ready to make prints in the process illustrated in FIG. 5. The process is executed by the controller 114. Once activated, the process illustrated in FIG. 7 is executed periodically (100 msec (milliseconds)) by the controller 114.

In step S302, the controller 114 sets an error counter N to zero. In step S303, the controller 114 determines whether the phase of the BD signal matches with the phase of the reference clock signal ("IS PHASE LOCKED?") by judging whether a phase lock signal is output from the phase control circuit 111. If a phase lock signal is output from the phase control circuit 111, the controller 114 determines that the image forming apparatus is in a phase lock state (YES in step S303), and the processing proceeds to step S304. On the other hand, if no phase lock signal is output from the phase control circuit 111, the controller 114 determines that the image forming apparatus is not in the phase lock state (NO in step S303), and the processing proceeds to step S306. In step S304, the controller 114 sets the error counter N to zero. In step S305, the controller 114 stops the processing for 100 msec (milliseconds), and after 100 msec passes, the processing returns to step S303 to execute step S303.

In step S306, the controller 114 adds one to the error counter N. In step S307, the controller 114 refers to the value of the error counter N and determines whether the value of the error counter N is 10. If the controller 114 determines that the value of the error counter N is 10, the state that is not the phase lock state continues for one second (=100 msec×10 times) (second predetermined time), therefore, the processing proceeds to step S308. On the other hand, if the value of the error counter N is not 10, the processing returns to step S305. While the error processing in step S308 and subsequent steps is performed if the value of the error counter N is 10 in the present exemplary embodiment, the value of the error counter N is not limited to 10 (the state that is not the phase lock state continues for one second).

In step S308, the controller 114 determines whether the power source is in the voltage abnormal state where the voltage obtained by dividing the power source voltage Vcc at the voltage dividing resistors 115 and 116 and input to the controller 114 is lower than a predetermined voltage. If the controller 114 determines that the input voltage is lower than the predetermined voltage (if the power source is in the voltage abnormal state) (YES in step S308), the processing proceeds to step S310. On the other hand, if the controller 114 determines that the input voltage is not lower than the predetermined voltage (if the power source is not in the voltage abnormal state) (NO in step S308), the processing proceeds to step S309. In step S309, the controller 114 performs next BD control error processing. The controller 114 is configured to notify the control unit 130 that a BD control error occurs. The control unit 130 displays on a display section of the operation unit 140 a motor error occurrence, which indicates that an abnormality has occurred after the activation of the scanner motor 1003, and indicates the BD control abnormal mode. The BD control abnormal mode is the mode at the time of the occurrence of the abnormality. The control unit 130 stops the print operation, and the process is ended. In step S310, the controller 114 performs next power source error processing. The controller 114 is configured to notify the control unit 130 that a power source error occurs. The control unit 130 displays on a display section of the operation unit 140 the power source error occurrence, which indicates an abnormality of the power source device 150. The control unit 130 stops the print operation, and the process is ended.

As described above, according to the present exemplary embodiment, a notification can be accurately issued that the optical scanning device is not activated due to an abnormality in the power source device of the image forming apparatus. Further, according to the present exemplary embodiment, also the notification can be accurately issued that an abnormality during an image forming operation after the activation of the optical scanning device has occurred due to the abnormality of the power source device in the image forming apparatus.

The following describes a third exemplary embodiment. In the first and second exemplary embodiments, the error notification at the time of occurrence of the abnormality during the image forming or the abnormality in the optical scanning device performing image forming is described. In the cases where the image forming apparatus or personal computer (hereinafter, "PC") is connected to a network such as a local area network (LAN) configured within a company, printing is performed at the image forming apparatus in response to a user instruction to make prints given from the PC. The following describes an exemplary embodiment in which a host apparatus such as the PC is connected with the network and an operator monitors abnormal states of a plurality of image forming apparatuses connected with the network to concentrate the management of the plurality of image forming apparatuses.

[Network Configuration]

FIG. 7 illustrates the connection status of a plurality of image forming apparatuses 100, 200, and 300 and a host apparatus 50 in the present exemplary embodiment. The image forming apparatuses 100, 200, and 300 are each connected with a network line 70 via a network connection apparatus 160. The configurations and operations of the image forming apparatuses 100, 200, and 300 are similar to those described in the first and second exemplary embodiments, and the same reference numerals are used with respect to similar configurations to omit descriptions thereof. To concentrate the management of the plurality of image forming apparatuses 100, 200, and 300, the host apparatus 50 is connected with the network line 70. The host apparatus 50 is capable of collecting error information such as error codes displayed on the operation unit 140 at the time of an occurrence of an abnormality in the image forming apparatuses 100, 200, and 300 using a control unit 50*a* via the network line 70. In the image forming apparatuses 100, 200, and 300, the network connection apparatus 160 is connected with the control unit 130, and when the abnormality occurs in the optical scanning device 22, the control unit 130 displays error information on the operation unit 140 to notify the user of the occurrence of the abnormality. Further, the image forming apparatuses 100, 200, and 300 also transmit the error information to the host apparatus 50 via the network line 70.

The host apparatus 50 is connected with the network line 70 with which the image forming apparatuses 100, 200, and 300 are connected, and monitors the operational status of each image forming apparatus 100, 200, and 300 by receiving the error information from the image forming apparatuses 100, 200, and 300. If the image forming apparatuses 100, 200, and 300 detects an abnormal state of the optical scanning device 22, the image forming apparatuses 100, 200, and 300 transmit to the host apparatus 50 the error code described in the first exemplary embodiment and an identification number assigned to the image forming apparatus in which the abnormality occurs. If the control unit 50*a* of the host apparatus 50 receives the error information from the image forming apparatuses 100, 200, and 300, the control unit 50*a* displays on a display 50*b* of the host apparatus 50 error information as described below. Specifically, as described in the first exemplary embodiment, the error code is expressed in hexadecimal notation, so that the control unit 50*a* analyzes the error code and displays information as described below on the display 50*b*, which is a display apparatus, to make it easy for the operator to understand. For example, the display 50*b* shows the identification number of the image forming apparatus in which the abnormality occurs, whether the apparatus in the abnormal state is the power source device 150 or the optical scanning device 22, and whether the abnormality has occurred during the activation before the image forming or during the image forming if the abnormality has occurred in the optical scanning device 22. Further, the control unit 50*a* displays on the display 50*b* information about whether the error has occurred in the FG control mode, in the laser control mode, or in the BD control mode if the abnormality has occurred during the activation of the optical scanning device 22 prior to the image forming. This enables the operator to identify where the abnormality has occurred in the image forming apparatus based on the error information displayed on the display 50*b*. Thus, the operator or serviceman can prepare a replacement part of the power source device 150 or the optical scanning device 22 from which the abnormality is detected, and perform replacement promptly.

As described above, the management system for monitoring abnormalities in the image forming apparatuses is configured such that when an abnormality occurs, the image forming apparatus or the optical scanning device, in which the abnormality occurs, can be identified from a plurality of image forming apparatuses to perform a recovery operation promptly. In this way, the work load on the operator or serviceman at the time of the occurrence of an abnormality is reduced.

As described above, according to the present exemplary embodiment, a notification can be accurately issued that the optical scanning device is not activated due to an abnormality in the power source device of the image forming apparatus.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-174395, filed Sep. 11, 2017, which is hereby incorporated by reference herein in its entirety.

What is claimed is:

1. An image forming apparatus comprising:

an image forming portion including a photosensitive member, an optical scanning device including a light source configured to emit laser light, a rotary polygon mirror configured to deflect the laser light to scan the photosensitive member with the laser light, and a driving motor configured to rotate the rotary polygon mirror, wherein the image forming portion is configured to perform image forming by developing an electrostatic latent image formed on the photosensitive member with a toner;

a power source device configured to supply power to the image forming portion;

a voltage detection unit configured to detect an output voltage of the power source device;

a rotation detection unit configured to output a detection signal matching to a rotation speed of the rotary polygon mirror; and a controller configured to activate the driving motor with the power supplied from the power source device to cause the image forming portion to form an image in response to input of image data for forming the image, wherein the controller detects whether an abnormality occurs in the power source device or the optical scanning device based on a detection result of the voltage detection unit and a detection result of the rotation detection unit, and the controller notifies where the abnormality occurs, wherein if the controller detects an abnormality in the output voltage of the power source device, the controller notifies the abnormality of the power source device, and wherein if the controller detects no abnormality in the output voltage of the power source device after the image data is input and before the driving motor is activated in response to the input of the image data, the controller activates the driving motor, and if the rotary polygon mirror does not reach a target speed within a predetermined time, the controller re-detects whether there is the abnormality in the output voltage of the power source device, and if the controller detects the abnormality in the output voltage of the power source device in re-detecting whether there is the abnormality in the output voltage of the power source device, the controller notifies the abnormality of the power source device, whereas if the controller detects no abnormality in the output voltage of the power source device in re-detecting whether there is the abnormality in the output voltage of the power source device, the controller notifies the abnormality of the optical scanning device.

2. The image forming apparatus according to claim 1, wherein in a case where the controller activates the optical scanning device, the controller sets a control mode for controlling the optical scanning device to a rotation control mode and changes the control mode to a laser control mode, a speed control mode, and a phase control mode in this order based on a state of the driving motor to activate the optical scanning device.

3. The image forming apparatus according to claim 2, wherein the driving motor includes a rotor portion which includes a plurality of magnetic poles and on which the rotary polygon mirror is provided, wherein the optical scanning device includes a signal generation unit configured to detect a change in magnetic flux generated by rotation of the driving motor and generate a rotation period signal, and wherein in the rotation control mode, the controller drives the driving motor to drive the rotary polygon mirror, and if a first lock signal is output from the rotation detection unit, the controller changes the control mode from the rotation control mode to the laser control mode.

4. The image forming apparatus according to claim 3, wherein the rotation detection unit outputs the first lock signal if a rotation speed of the driving motor that is calculated based on the rotation period signal generated by the signal generation unit is within a range of a first target rotation speed.

5. The image forming apparatus according to claim 4, wherein the optical scanning device includes a light beam detection unit configured to detect a light beam emitted from the light source and deflected by the rotary polygon mirror and output a detection signal, and wherein in the laser control mode, if the detection signal is output from the light beam detection unit, the controller changes the control mode from the laser control mode to the speed control mode.

6. The image forming apparatus according to claim 5, wherein in the speed control mode, if a second lock signal is output from the rotation detection unit, the controller changes the control mode from the speed control mode to the phase control mode.

7. The image forming apparatus according to claim 6, wherein the rotation detection unit outputs the second lock signal if the rotation speed of the driving motor that is calculated based on the detection signal output from the light beam detection unit is within a range of a second target rotation speed different from the first target rotation speed.

8. The image forming apparatus according to claim 7, wherein the controller includes a phase control unit configured to control the rotation of the driving motor such that a phase of the detection signal output from the light beam detection unit matches with a phase of a reference clock signal for driving the optical scanning device, and if the phases match with each other, the phase control unit outputs a third lock signal, and wherein in the phase control mode, if the third lock signal is output from the phase control unit, an image forming operation is initiated.

9. The image forming apparatus according to claim 8, wherein in a case where the third lock signal is not output from the phase control unit although a first predetermined time passes from when the control mode for controlling the optical scanning device is set to the rotation control mode, if an abnormality in the output voltage of the power source device that is detected by the voltage detection unit is detected, the controller notifies error information indicating the abnormality of the power source device, whereas if no abnormality in the output voltage of the power source device that is detected by the voltage detection unit is detected, the controller notifies error information about the optical scanning device including information about the control mode.

10. The image forming apparatus according to claim 8, wherein in a case where the third lock signal is not output continuously from the phase control unit for a second predetermined time while the image forming operation is executed, if an abnormality in the output voltage of the power source device that is detected by the voltage detection unit is detected, the controller notifies error information indicating the abnormality of the power source device, whereas if no abnormality in the output voltage of the power source device that is detected by the voltage detection unit is detected, the controller notifies error information about the optical scanning device including information about the phase control mode.

11. The image forming apparatus according to claim 9, further comprising a display portion configured to display the error information, wherein the displayed error information includes information about an apparatus in which the abnormality has occurred, and in a case where the apparatus in which the abnormality has occurred is the optical scanning device, the displayed error information includes the information about the control mode, and wherein the controller displays the error information on the display portion.

12. An image forming apparatus comprising:

an image forming portion including a photosensitive member, an optical scanning device including a light source configured to emit laser light, a rotary polygon mirror configured to deflect the laser light to scan the photosensitive member with the laser light, and a driving motor configured to rotate the rotary polygon mirror, wherein the image forming portion is configured to perform image forming by developing an electrostatic latent image formed on the photosensitive member with a toner;

a power source device configured to supply power to the image forming portion including the optical scanning device;

an overcurrent protection circuit configured to detect a current output from the power source, and configured to stop a supply of the current to the optical scanning device in a case where the current detected by the overcurrent protection circuit is not less than a predetermined current value;

a rotation detection unit configured to output a detection signal corresponding to a rotation speed of the rotary polygon mirror; and a controller configured to detect whether an abnormality occurs in the optical scanning device or not, wherein, in a case where the rotation detection unit detects that the period of the detection signal does not reach a target period within a predetermined time after the activation of the rotary polygon mirror according to an inputting of an image data for forming the image, the controller detects a current supplied to the optical scanning device from the power source device, and, wherein in a case where the controller detects that the current is not supplied from the power source device to the optical scanning device, the controller does not notify an error of the optical scanning device, in a case where the controller detects that the current is supplied from the power source device to the optical scanning device, the controller notifies the error of the optical scanning device.

13. The image forming apparatus according to claim 12, further comprising a display portion configured to display an error information indicating the error of the optical scanning device.

14. The image forming apparatus according to claim 12, wherein in a case where the controller detects that the current is not supplied from the power source device to the optical scanning device, the controller notifies an error of the power source device.

15. The image forming apparatus according to claim 14, further comprising a display portion configured to display an error information indicating the error of the optical scanning device or an error information indicating the error of the power source device.

16. The image forming apparatus according to claim 15, wherein the controller is configured to output the error information indicating the error of the optical scanning device or the error information indicating the error of the power source device to a management apparatus connected to the image forming apparatus via a network.

17. The image forming apparatus according to claim 12, wherein the optical scanning apparatus includes a optical sensor configured to receive the laser light deflected the rotary polygon mirror and output a first signal included in the detection signal based on a reception of the laser light deflected the rotary polygon mirror, and a signal generator configured to detect a change in a magnetic flux in accordance with a rotation of the driving motor including a rotor provided with a magnet and output a second signal included in the detection signal based on a detection of the change in a magnetic flux, wherein in a case where the controller detects that the current is supplied from the power source device to the optical scanning device and the first signal does not reach a target period corresponding to the first signal within a predetermined time, the controller notifies an error of the light source as the error of the optical scanning device, and wherein in a case where the controller detects that the current is supplied from the power source device to the optical scanning device and the second signal does not reach a target period corresponding to the second signal within a predetermined time, the controller notifies an error of the driving motor as the error of the optical scanning device.

18. The image forming apparatus according to claim 17, further comprising a display portion configured to display an error information indicating the error of the light source or an error information indicating the error of the driving motor.

19. The image forming apparatus according to claim 18, wherein the controller is configured to output the error information indicating the error of the light source or the error information indicating the error of the driving motor to a management apparatus connected to the image forming apparatus via a network.

* * * * *